US006926317B2

(12) United States Patent
Thomas et al.

(10) Patent No.: US 6,926,317 B2
(45) Date of Patent: Aug. 9, 2005

(54) SECURITY SEAL

(75) Inventors: Gareth William Thomas, Eaglescliffe (GB); George Relton McMillan, Hartlepool (GB); David Austin Burt, Berkshire (GB)

(73) Assignee: ITW Limited, Swansea (GB)

( * ) Notice: Subject to any disclaimer, the term of this patent is extended or adjusted under 35 U.S.C. 154(b) by 0 days.

(21) Appl. No.: 10/392,312

(22) Filed: Mar. 20, 2003

(65) Prior Publication Data

US 2003/0178860 A1 Sep. 25, 2003

(30) Foreign Application Priority Data

Mar. 21, 2002 (EP) ..... 02252042

(51) Int. Cl.[7] ..... B65D 27/30
(52) U.S. Cl. ..... 292/307 R; 292/307 A
(58) Field of Search ..... 292/307 A, 307 R, 292/325, 315, 322, 318, 324; 40/632, 633, 316, 6

(56) References Cited

U.S. PATENT DOCUMENTS 178,722 A * 6/1876 Brooks
1,017,950 A * 2/1912 Brooks ..... 292/317
1,577,372 A * 3/1926 Seline
1,615,057 A * 1/1927 Tyden
1,654,547 A * 1/1928 Martineau
2,548,104 A * 4/1951 Frison ..... 40/1.6
4,142,310 A * 3/1979 Groselak ..... 40/21 R
5,116,091 A * 5/1992 Swift ..... 292/318
5,219,194 A * 6/1993 Trent ..... 292/307 R
5,235,729 A * 8/1993 Tiegs ..... 24/20 CW
5,377,387 A * 1/1995 Freed ..... 24/16 PB
5,704,097 A * 1/1998 Rahav ..... 24/16 PB
6,511,108 B1 * 1/2003 Roessner et al. ..... 292/320

* cited by examiner

*Primary Examiner*—Gary Estremsky
(74) *Attorney, Agent, or Firm*—Lowe Hauptman & Berner, LLP

(57) ABSTRACT

Security seals (1) are widely used to demonstrate the integrity of a closed container, truck, roll pallet, cage or box. Typically such security seals (21) are made from plastics material and have a strap (2) with a plug (5) at one end and a socket (4) at the other end. The socket includes a one-way lock so that when the security seal (1) is threaded through a locking point and the plug (5) inserted into the socket (4) the plus is locked irremovably into the socket. The only way that the security seal can subsequently be removed is by destroying it. Such a security seal (1) includes a recognizable sequence of indicia (20) extending along substantially the whole length of the strap portion (2) . The presence of the recognizable sequence of indicia (20) along the length of the strap (2) make it almost impossible to cut such a strap (2) and reconnect the cut ends without disrupting the sequence of indicia (20) so that it is immediately evident that the security seal (1) has been tampered with.

30 Claims, 2 Drawing Sheets

SECURITY SEAL

BACKGROUND OF THE INVENTION

Security seals are widely used to demonstrate the integrity of a closed container, truck, roll pallet, cage or box to demonstrate, for example, that they have not been opened during transit. Typically such security seals are made from plastics material and comprise a strap with a plug at one end and a socket at the other end. The socket includes a one-way lock. In this way, the security seal is threaded through a locking point and the plug inserted into the socket. The plug is then locked irremovably into the socket so that the only way in which the security seal can subsequently be removed is by destroying it. Typically the security seal includes a unique serial number so that it can be confirmed that the same seal is still present after transport as was applied before transport, and the security seal may include a flag portion to carry this serial number.

SUMMARY OF THE INVENTION

Attempts are made to breach the security of such seals by, for example, cutting the strap portion of the seal to enable it to be removed and the container, or whatever, opened. Then, after replacing the security seal the cut ends of the security seal are adhered or welded together. Such tampering, particularly when heat welding is used, can be difficult to spot when the security seal is checked for integrity.

According to this invention such a security seal includes a recognizable sequence of indicia extending along substantially the whole length of the strap portion. The presence of the recognizable sequence of indicia along the length of the strap make it almost impossible to cut such a strap and reconnect the cut ends without disrupting the sequence of indicia so that it is immediately evident that the security seal has been tampered with.

Preferably the seal carries a recognizable sequence of individual indicia on opposite sides of the strap. In this case the indicia on opposite sides of the strap are preferably of different form thus, they may be of different typestyle and/or indicia on one side of the strap may be recessed whilst, on the other side they are raised, for example. The indicia may be "joined up" in the manner of handwriting or, alternatively, have the form of normal: printing. It is also preferred that any space between adjacent indicia on one side of the strap is locate directly opposite indicia on the opposite side of the stray so that, at no point, can a cut be made through the stray without cutting through indicia on one or other side of the strap. To further assist this it is convenient if the indicia on one side of the strap are in an "italic" font and so are sloping in one direction, whereas the indicia on the other side of the strap are either in a normal font or: are arranged to be inclined in the opposite direction. In this way the indicia on opposite sides of the stray certainly overlap one another and any spaces in between.

The recognizable sequence of indicia may be, for example, the letters of the alphabet arranged in alphabetical order along the length of the strap or may be formed by a continuous number sequence. The alphabet may be English or that of another language such as Greek or Russian. Where the indicia are formed by letters they may even form a recongnizable long word such a: "supercalifragalisticex-pealedotious" or even be arranged to form a well known phrase such as an advertising slogan. In one particular example the recognizable sequence of individual indicia are provided by intercalated upper and lower case indicia arranged in alphabetical order extending from one end of the strap to the other.

BRIEF DESCRIPTION OF THE DRAWINGS

A particular example of as a security seal in accordance with this invention will now be described with reference to the accompanying drawings; in which.

DESCRIPTION OF PREFERRED EMBODIMENTS

Figure 1:
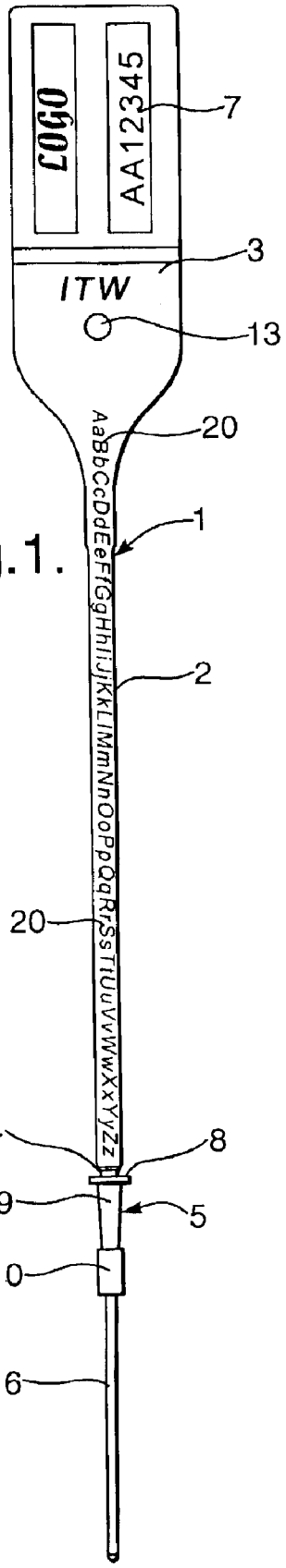
FIG. 1 is a front elevation.
Figure 2:
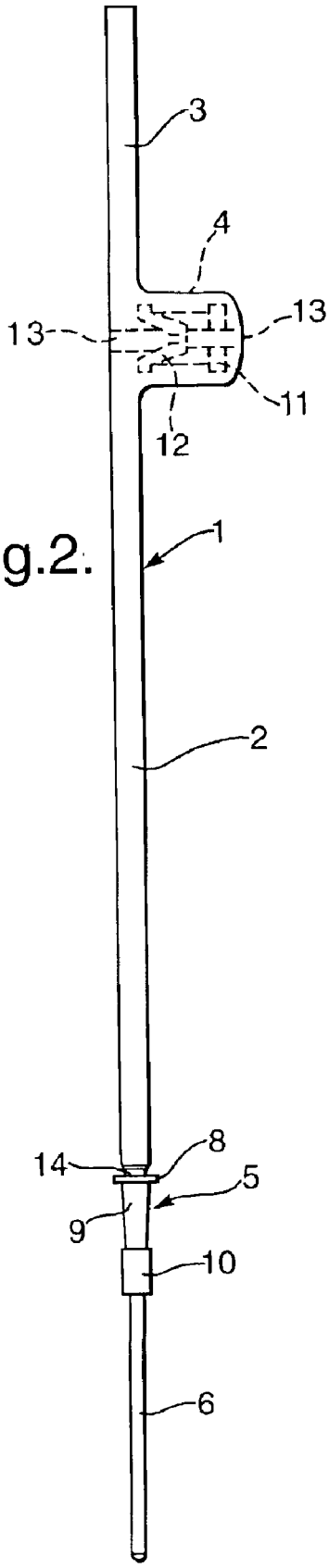
FIG. 2 is a side elevation.

The security seal 1 comprises a strap portion 2 having a flag 3 and socket 4 at one end and a plug 5 and tail 6 at the opposite end. The flag 3 carries a unique identification number 7 which may be in the form of a bar code and may also carry a logo, for example. The plug 5 includes a collar 8 a frusto-conical portion 9 and a locking spigot 10. The socket 4 includes an insert 11 having resilient locking fingers 12 and an aperture 13. Typically, the seal 1 is formed from high density polyethylene with the insert 11 formed by acetal and included in the seal 1 as part of an insert moulding operation.

To use the seal 1 the tail 6, plug portion 5 and strap 2 are threaded through a locking point and then the tail 6 inserted into the aperture 13. As the tail 6 is threaded through the aperture 13 and the plug, in particular the locking spigot 10 passes between the resilient fingers 12 until the collar 8 engages the face of the flag portion 3 which prevents the socket portion 5 being inserted any further. However, at this point, the resilient fingers 12 have closed behind the shoulder formed between the locking spigot 10 and the frusto-conical portion 9 to prevent withdrawal of the plug portion 5 from the socket 4. A weakened portion 14 of the strap 2 is provided immediately behind the collar 8. When the seal is subjected to undue strain attempting to remove the plug 5 from the socket 4 the seal fails at this weakened portion 14 rather than by releasing the plug 5 from the socket 4.

Figure 3:
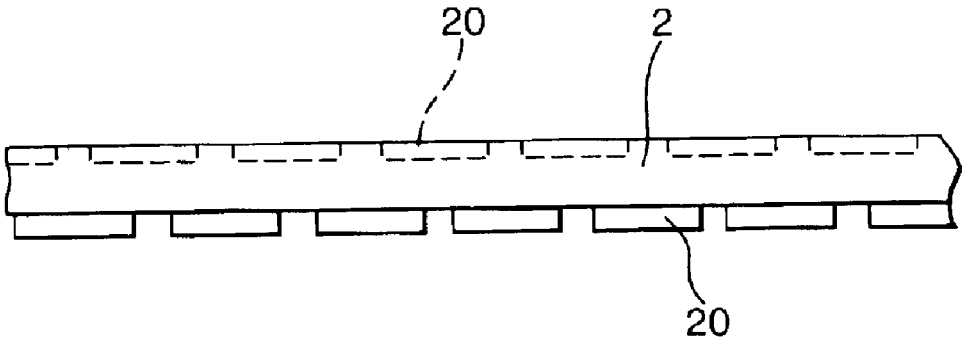
FIG. 3 is a partial schematic side elevation drawn to a larger scale.
Figure 4:
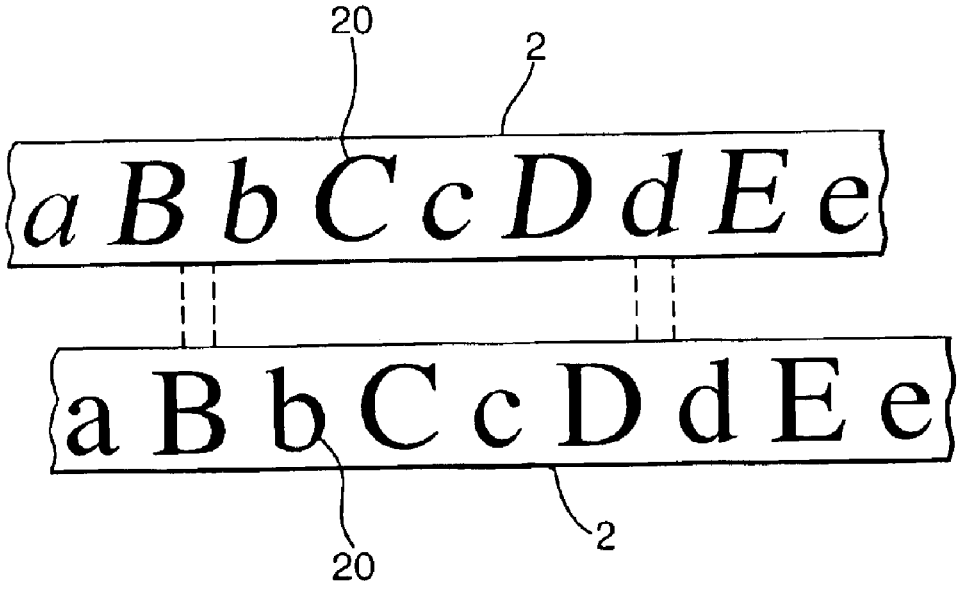
FIG. 4 is a partial front and rear elevation showing how the indicia on opposite sides of the strap are offset from one another.

The seal is also provided with a recognizable sequence of individual indicia 20 along the length of the strap portion 2. In this example, indicia are provided on both sides of the strap portion 2 with the indicia on the front face being indented whilst those on the rear face project outwards, as shown in FIG. 3. Indicia 20 on the front face are also formed in an italic font, whereas the indicia on the rear face are formed in an upright font, as best shown in FIG. 4. The indicia on the front and rear faces are also off set longitudinally from one another so that any space between adjacent indicia on the front face corresponds to the location of an indicia on the rear face, again shown in FIG. 4. In this way there is no portion of the strap that can be cut without the cut passing through indicia on at least one face. The recognizable sequence of indicia used in this example is an intercalated upper and lower case English language alphabet, with the alphabet starting at the end of the strap adjacent the socket 4 and the end of the alphabet being adjacent the weakened zone 14.

We claim:

1. A security seal, comprising a strap having opposite first and second ends defining a length therebetween;

a plug at the first end of said strap; and a socket at the second end of said strap;

wherein said security seal includes a recognizable sequence of indicia extending along substantially the whole said length;

said seal carries said recognizable sequence of indicia on opposite sides of said strap; and any space between adjacent indicia on one side of said strap is located directly opposite at least one of the indicia on the opposite side of said strap, whereby at no point along said length can a cut be made through said strap without cutting through at least one of said indicia.

2. The security seal of claim 1, wherein said plug is configured to be locked irremovably into said socket.

3. The security seal of claim 2, wherein said indicia on said opposite sides of said strap are of different form.

4. The security seal of claim 2, wherein said indicia on said opposite sides of said strap are of different type style.

5. The security seal of claim 1, wherein said indicia on one side of said strap are recessed and said indicia on another side of said strap are raised.

6. The security seal of claim 2, wherein said recognizable sequence of indicia are the letters of the alphabet arranged in alphabetical order along said length.

7. The security seal of claim 6, wherein said recognizable sequence of indicia are provided by intercalated upper and lower case indicia arranged in alphabetical order extending from said first end to said second end.

8. The security seal of claim 1, wherein said recognizable sequence of indicia on both sides of said strip are the letters of the alphabet arranged in alphabetical order along said length.

9. The security seal of claim 1, wherein said recognizable sequence of indicia on both sides of said strip are provided by intercalated upper and lower case indicia arranged in alphabetical order extending from said first end to said second end.

10. The security seal of claim 2, wherein said strap includes a weakened portion having a mechanical strength weaker than that of a connection between the plug and the socket when the plug is locked into the socket, whereby if said seal is subject to a sufficient strain after the plug has been locked into the socket, said seal will fail at said weakened portion rather than at said connection.

11. The security seal of claim 2, wherein said sequence of indicia includes a continuous number sequence.

12. The security seal of claim 10, wherein said weakened portion is located between said plug and socket and immediately adjacent one of said plug and socket.

13. The security seal of claim 10, wherein said weakened portion is located immediately adjacent one of said plug and socket and between said one of said plug and socket and said sequence of indicia.

14. A security seal, comprising a strap having opposite end portions and two matching locking elements each at one of said end portions, said locking elements being lockable one into another and spaced one from another by a length of said strap;

wherein said security seal includes at least one recognizable sequence of indicia extending along said length of said strap between said locking elements in such a manner that at no point along said length can a cut be made through said strap without cutting through at least one of said indicia.

15. The security seal of claim 14, wherein said security seal includes two said recognizable sequences of indicia; and any space between adjacent indicia of one of said sequences is located to correspond to at least one of the indicia of the other sequence.

16. The security seal of claim 14, wherein said security seat includes two said recognizable sequences of indicia; and the indicia of one of said sequences are slanted with respect to the indicia of the other sequence.

17. The security seal of claim 14, wherein said security seal includes two said recognizable sequences of indicia; and the indicia of said sequences are inclined in opposite directions.

18. The security seal of claim 14, wherein adjacent said indicia are joined together in a handwriting manner.

19. The security seal of claim 14, wherein said locking elements are irremovably lockable one into another.

20. The security seal of claim 14, wherein said seal carries said recognizable sequence of indicia on opposite sides of said strap.

21. The security seal of claim 20, wherein said indicia on said opposite sides of said strap are of different form.

22. The security seal of claim 20, wherein said indicia on said opposite sides of said strap are of different type style.

23. The security seal of claim 20, wherein said indicia on one side of said strap are recessed and said indicia on another side of said strap are raised.

24. The security seal of claim 20, wherein any space between adjacent indicia on one side of said strap is located directly opposite at least one of the indicia on the opposite side of said strap.

25. The security seal of claim 14, wherein said recognizable sequence of indicia are the letters of the alphabet arranged in alphabetical order along said length.

26. The security seal of claim 25, wherein said recognizable sequence of indicia are provided by intercalated upper and lower case indicia arranged in alphabetical order extending from said first end to said second end.

27. The security seal of claim 14, wherein said sequence of indicia includes a continuous number sequence.

28. The security seal of claim 14, wherein said strap includes a weakened portion having a mechanical strength weaker than that of a connection between the locking elements when the locking elements are locked one into another, whereby if said seal is subject to a sufficient strain thereafter, said seal will fail at said weakened portion rather than at said connection.

29. The security seal of claim 28, wherein said weakened portion is located between said locking elements and immediately adjacent one of said locking elements.

30. The security seal of claim 28, wherein said weakened portion is located immediately adjacent one of said locking elements and between said one of said locking elements and said sequence of indicia.

* * * * *